United States Patent [19]

Phillips

[11] 4,036,108

[45] July 19, 1977

[54] PRESSURE FLUID OPERATED PERCUSSION TOOLS

[75] Inventor: Reginald Andrew Phillips, Warrington, England

[73] Assignee: Dobson Park Industries, Ltd., Colwick, England

[21] Appl. No.: 612,915

[22] Filed: Sept. 12, 1975

[51] Int. Cl.[2] ..... F01L 25/06

[52] U.S. Cl. ..... 91/165; 91/308; 91/317; 91/330; 92/134

[58] Field of Search ..... 91/330, 335, 274, 263, 91/247, 219, 317, 299, 308, 246, 165, 284

[56] References Cited

U.S. PATENT DOCUMENTS

| | | | |
|---|---|---|---|
| 2,609,791 | 9/1952 | Bohlman | 91/317 |
| 3,184,770 | 5/1965 | Phillips et al. | 91/263 |
| 3,425,498 | 2/1969 | Bick | 91/335 |
| 3,683,746 | 8/1972 | Ramspeck | 91/263 |
| 3,800,664 | 4/1974 | Phillips | 91/317 |

*Primary Examiner*—Paul E. Maslousky

*Attorney, Agent, or Firm*—Brady, O'Boyle & Gates

[57] ABSTRACT

In a percussion tool a means is provided for delaying the manifestation, on a valve means sensitive to such change in pressure, of a change in pressure of the fluid applied to the hammer piston at one end thereof and which drives such hammer piston in its working stroke, the valve means being that means which serves to control the inlet and exhaust parts of the fluid circuit which applies pressure to the other end of the piston.

5 Claims, 1 Drawing Figure

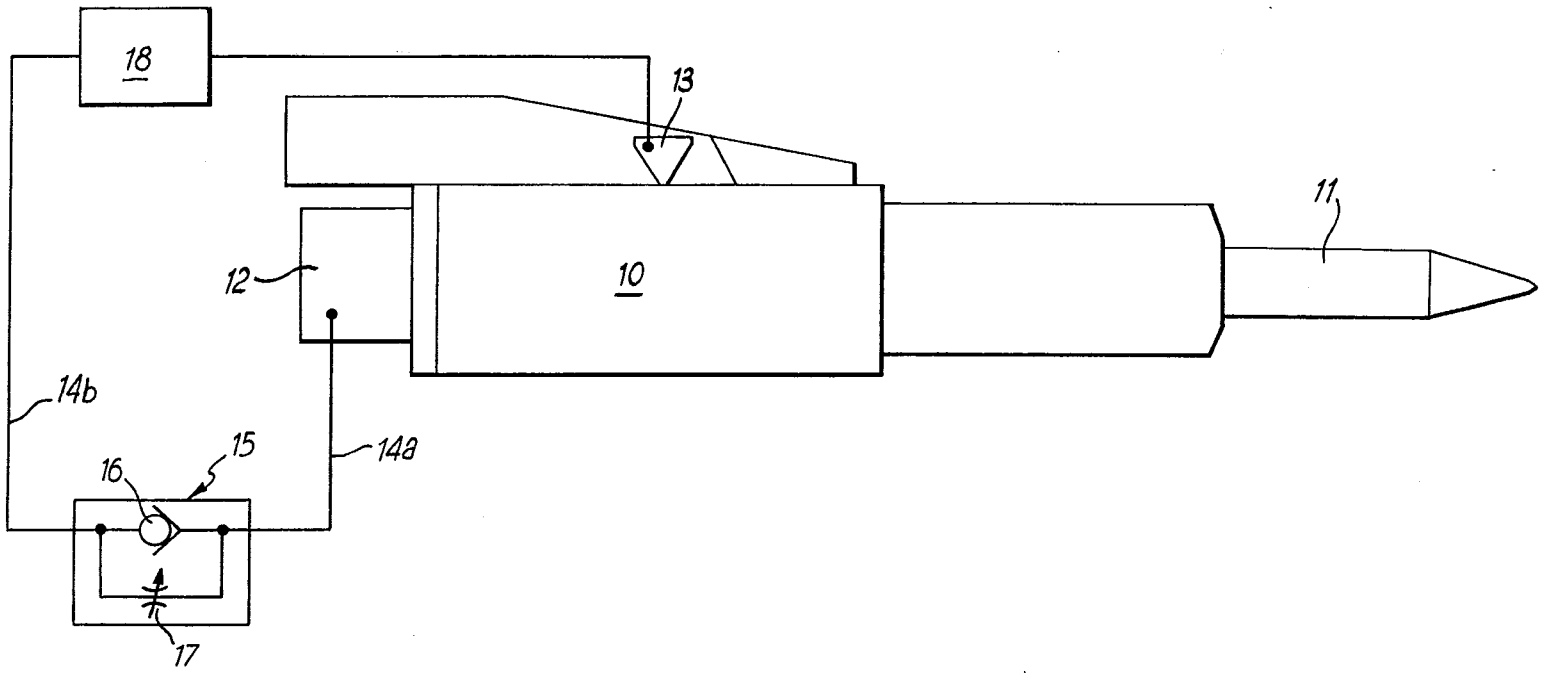
11
13
10
14a
12
15
18
16
17
14b

PRESSURE FLUID OPERATED PERCUSSION TOOLS

This invention concerns improvements in or relating to percussion tools of the kind (hereinafter referred to as the kind specified) in which a hammer piston is driven in one direction by pressure fluid so as to compress air or a gaseous fluid, hereinafter referred to simply as "a fluid", in a chamber, which compressed fluid is subsequently allowed to expand and impart a working stroke to said hammer piston in the opposite direction, operation of the tool being controlled by valve means responsive to changes in fluid pressure in, for example, said chamber or in a chamber or pressure fluid circuitry associated therewith.

One example of such a percussion tool, to which the present invention is particularly applicable, is described in the Specification of our U.S. Pat. No. 3,800,664.

According to the present invention there is provided a percussion tool of the kind specified wherein means is provided for delaying or retarding the manifestation of a change in pressure of the fluid in the chamber, at the valve means, which manifestation is necessary for the operation of the valve means responsive thereto, whereby the rate of operation of the tool is reduced.

Conveniently the arrangement is such that it is the backward or return stroke of the hammer piston, during which the fluid in the chamber is compressed, which is delayed, but the arrangement may be such that the forward or impacting stroke of the piston is delayed or such that there is a delay both in the forward and in the reverse strokes of the piston. Whatever the arrangement, it is such that the number of blows per minute made by the hammer piston is reduced in relation to the blows per minute which the hammer piston would make if no such arrangement were provided.

The invention will now be described further, by way of example only, with reference to the single FIGURE of the accompanying drawings, which illustrates, in diagrammatic manner, one embodiment thereof as applied to a percussion tool of a general construction similar to that of the percussion tool described in our prior U.S. Pat. No. 3,800,664.

Referring now to the drawing, the tool shown therein comprises a cylinder 10 having a hammer piston movable therein which is adapted to impart blows to a chisel 11 slidably supported at the forward end of the tool.

In operation, the hammer piston is driven rearwardly, by hydraulic fluid under pressure which is introduced into the cylinder 10, and compresses air or gas present in a chamber 12. As the hydraulic fluid is permitted to exhaust from the cylinder 10, the compressed gas drives the piston forwardly so that it strikes the chisel.

The inlet and exhaust of hydraulic fluid to and from the cylinder 10 to control movement of the piston is controlled by valve means responsive to the gas pressure in the chamber 12, such valve means including a pilot valve 13 connected to the chamber 12 by a pipeline **14*a*, 14*b* and sensitive to pressure in such chamber 12. It will be understood that as the hammer piston makes a forward impacting stroke, under the action of the gas in the chamber 12, the gas pressure in said chamber will fall. At a predetermined low gas pressure, the pilot valve 13 will be operated to cause a spool or other valve to close the hydraulic fluid exhaust and to open the hydraulic fluid inlet of the cylinder 10**, thus to drive the hammer piston rearwardly.

Thus far the structure is of conventional form. In accordance with the present invention, a gas pilot delay device 15 is provided in the pipe-line **14*a*, 14*b*, such device comprising a non-return valve 16 and an adjustable restrictor valve 17 arranged in parallel therewith. If desired, a reservoir 18 may be connected in section 14*b*** of the pipe-line.

The operation of the percussion tool provided with the delay device is as follows:

When the hammer piston is making its return stroke, gas flows in unrestricted manner through the delay device 15 and into the chamber 12 until the pressure in such chamber 12 reaches a predetermined high value at which the valve means is set to operate, all in accordance with conventional practice. Operation of the valve means on attainment of such predetermined high pressure closes the hydraulic fluid inlet to the cylinder 10 and opens the exhaust thereof, the hammer piston then being driven forwardly under the influence of the pressure of the fluid in chamber 12.

The operation of the tool embodying the present invention differs from conventional practice in that the attainment of the low pressure necessary for operation of the pilot valve in a sense appropriate to effect return or rearward motion of the piston is delayed by the retarding effect of the delay device 15, on the reduction of gas pressure within pipe-line **14*b* which pressure is that which is applied to the pilot valve 13, and thus the initiation of return or rearward motion is delayed relative to the timing of the forward, or working, stroke of the piston. The extent to which operation of the pilot valve 13, and thus inititation of the return or rearward motion of the piston, is delayed can be varied by adjustment of the setting of the restrictor valve 17**. The overall result of this is that there is a reduction in the number of blows per minute of the hammer piston on the chisel.

The invention is not restricted to the exact features of the embodiment hereinbefore described and illustrated, since alternatives will readily present themselves to one skilled in the art. Thus, an analogous arrangement might be provided to retard the build-up of pressure in pipeline **14*b*, and thus delay the application of a high gas pressure in chamber 12 to the pilot valve 13, thereby delaying the initiation of the forward, or working, stroke of the piston. This effect can be achieved simply by reversing the non-return valve in relation to the disposition of such valve in the embodiment illustrated. If it is required to delay initiation of both forward and return strokes of the piston, then the non-return valve is omitted, and the increase or decrease of gas pressure within the pipe-line 14*b* is controlled solely by the restrictor valve 17**.

What we claim is:

1. In a percussion tool having a hammer piston slidably mounted in a cylinder, said piston being driven in one direction by first fluid means applied to said cylinder on one side of the piston which acts to compress second fluid means on the other side of the piston, said second fluid means when compressed being subsequently allowed to expand by exhausting said first fluid means from said one side of the piston and drive said piston in the opposite direction, the improvement comprising: pressure responsive valve means controlling the application and exhausting of said first fluid means to and from said cylinder, and delay means coupled between said valve means and said other side of said piston, said delay means including a restrictor valve through which the fluid of the second fluid means flows and a one-way valve arranged in parallel with the restrictor valve, said delay means being operable to selectively delay or retard the manifestation of a change in pressure of said second fluid means to said valve means whereby the rate of operation of said tool is reduced.

2. A percussion tool as claimed in claim 1, wherein the restrictor valve is adjustable.

3. A percussion tool as claimed in claim 1 wherein said first fluid means comprises first type fluid means and said second fluid means comprises second type fluid means.

4. A percussion tool as defined in claim 3 wherein said first type of fluid means comprises hydraulic fluid means and said second type fluid means comprises gaseous fluid means in a chamber of said cylinder, said valve means being responsive to a delayed pressure change of the gaseous fluid means in said chamber and wherein said one direction corresponds to a return stroke of the piston and said opposite direction corresponds to a working stroke of the piston.

5. A percussion tool having a hammer piston slidably mounted in a cylinder, said piston being driven in one direction by first fluid means applied to said cylinder on one side of the piston which acts to compress second fluid means on the other side of the piston, said second fluid means when compressed being subsequently allowed to expand by exhausting said first fluid means from said one side of the piston and drive said piston in the opposite direction, and including pressure responsive valve means controlling the application and exhausting of said first fluid means to and from said cylinder, and delay means coupled between said valve means and said other side of said piston, the said delay means including a restrictor valve through which the fluid of the second fluid means flows and a one-way valve arranged in parallel with the restrictor valve operable to permit free fluid flow from the piston, the delay means being operable to selectively delay or retard the manifestation of a reduction in pressure of said second fluid means to said valve means to delay initiation of the return stroke of the piston following a working stroke thereof whereby the rate of operation of said tool is reduced.

* * * * *